US005169145A

United States Patent [19]

Jang

[11] Patent Number: 5,169,145

[45] Date of Patent: Dec. 8, 1992

[54] LENGTH ADJUSTABLE HANDLE

[76] Inventor: Hwang-Shan Jang, No. 451, Ta Tien Rd., Ho Mei Chien, Changhwa Hsien, Taiwan

[21] Appl. No.: 894,547

[22] Filed: Jun. 5, 1992

[51] Int. Cl.[5] ..... A63B 49/08

[52] U.S. Cl. ..... 273/73 J; 273/81.2

[58] Field of Search ..... 273/73 R, 73 J, 75, 273/81 R, 81.2, 67 DA

[56] References Cited

U.S. PATENT DOCUMENTS

| | | | |
|---|---|---|---|
| 3,674,267 | 7/1972 | Hollis | 273/75 |
| 3,833,219 | 9/1974 | Dean | 273/75 |
| 4,007,929 | 2/1977 | Figa | 273/73 J X |
| 4,101,125 | 7/1978 | Heath | 273/73 J X |
| 4,575,082 | 3/1986 | Mott et al. | 273/73 J X |
| 4,641,838 | 2/1987 | Gabrielidis | 273/73 J |
| 4,943,058 | 7/1990 | Carbonetti | 273/73 J |
| 5,083,779 | 1/1992 | Ungermann | 273/81.2 X |

FOREIGN PATENT DOCUMENTS

| | | | |
|---|---|---|---|
| 839697 | 4/1939 | France | 273/73 J |

*Primary Examiner*—Theatrice Brown
*Assistant Examiner*—William E. Stoll
*Attorney, Agent, or Firm*—Varndell Legal Group

[57] ABSTRACT

A handle comprised of a rod base sleeved with a front socket, a rear socket and an intermediate socket respectively retained in place by nuts and compression springs, the rod base comprising a collar with a name plate mounted thereon, and a notched ring formed into a set of teeth respectively spaced by a set of grooves, the rear socket having one end formed into two symmetrical sets of teeth respectively spaced by a set of grooves, the intermediate socket having two opposite ends respectively formed into a set of teeth respectively engaged with the teeth on the notched ring and the rear socket. By changing the engagement order of the teeth of the intermediate socket with the teeth of the notched ring and the teeth of said rear socket, the total length of the handle is changed.

1 Claim, 4 Drawing Sheets

LENGTH ADJUSTABLE HANDLE

BACKGROUND AND SUMMARY OF THE INVENTION

The present invention relates to apparatus handles, and more particularly, the present invention relates to a length adjustable handles for apparatus that can be conveniently to change its total length.

Any of a variety of apparatus and devices including rackets, golf clubs, fishing rods, umbrellas, tools, etc. shall have a handle or handles to be grasped by the hand. The length of a tool handle, racket, etc. has great concern with applied mechanics. It is better to design a handle according to the user's body size or physical strength. However, it is expensive to manufacture the same products with different handles.

The present invention has been accomplished to eliminate the aforesaid problem. It is therefore an object of the present invention to provide a length adjustable handle which can be conveniently adjusted into the desired length. It is another object of the present invention to provide a length adjustable handle which is convenient to operate. It is still another object of the present invention to provide a length adjustable handle which is inexpensive to manufacture.

According to the preferred embodiment of the present invention, the length adjustable handle is comprised of a rod base sleeved with a front socket, a rear socket and an intermediate socket respectively retained in place by nuts and compression springs, wherein the rod base comprises a collar with a name plate mounted thereon, and a notched ring formed into two symmetrical sets of teeth respectively spaced by two symmetrical sets of grooves; the rear socket has one end formed into two symmetrical sets of teeth respectively spaced by two symmetrical sets of grooves; the intermediate sockets has two opposite ends respectively formed into two symmetrical set of teeth spaced by two symmetrical sets of grooves. By changing the engagement order of the teeth of the intermediate socket with the teeth of the notched ring and the teeth of the rear socket, the total length of the handle is changed.

BRIEF DESCRIPTION OF THE PREFERRED EMBODIMENT

DETAILED DESCRIPTION OF THE PREFERRED EMBODIMENT

Figure 1:
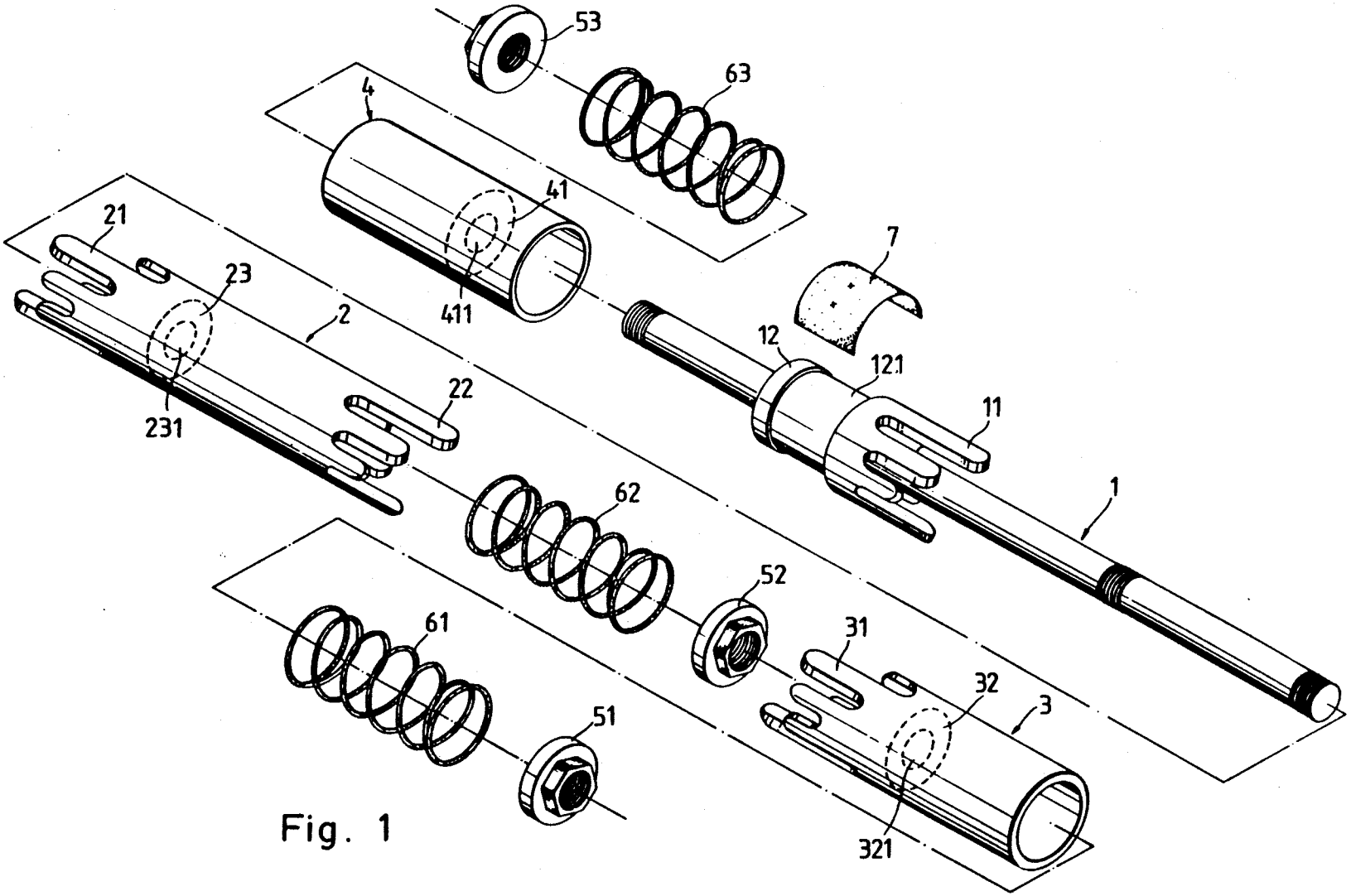
FIG. 1 is an exploded view of the preferred embodiment of the length adjustable handle of the present invention.

Referring to FIG. 1, therein illustrated is the preferred embodiment of the length adjustable handle of the present invention, which is generally comprised of a rod base 1, a front socket 4, a rear socket 3, an intermediate socket 2, three compression springs 61, 62, 63, and three nuts 51, 52, 53. The rod base 1 is made from an elongated rod having three spaced outer threads, namely, the first outer thread at one end, the second outer thread near the first outer thread, and the third outer thread at an opposite end, a collar 12 and a notched ring 11 concentrically formed between the second and third outer threads. The collar 12 of the rod base 1 has an annular groove 121 formed around the peripheral outside surface thereof, onto which a name plate 7 is fastened. The notched ring 11 is connected to the collar 12, and formed of two symmetrical sets of teeth respectively spaced by two symmetrical sets of grooves. The teeth and the grooves of the notched ring 11 vary in length. The outer diameter of the notched ring 11 is larger than the collar 12 but equal to the front socket, the intermediate socket 2 and the rear socket 3. The front, intermediate and rear sockets 4, 2, 3 have each a ring-shaped partition wall 41, 23 or 32 on the inside, which partition wall has a center hole 411, 231 or 321 through which the rod base 1 is inserted. The rear socket 3 has a notched peripheral end edge 31 at one end. The intermediate socket 2 has two notched peripheral end edges 21, 22 at two opposite ends. The notched end edges 31, 21, 22 are respectively made in the same shaped of the notched ring 11 of the rod base 1.

Figure 2:
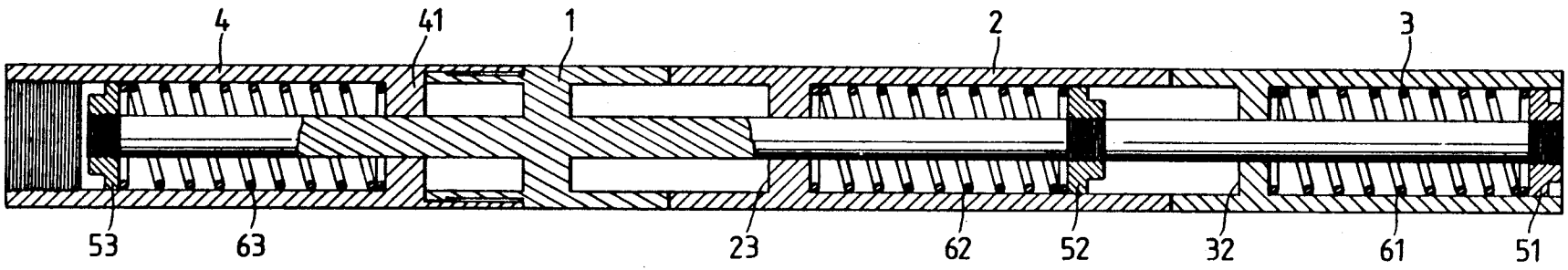
FIG. 2 is a sectional assembly view thereof taken in longitudinal direction.

Referring to FIG. 2 and seeing FIG. 1 again, the assembly process of the present invention is outlined hereinafter. After a name plate 7 having been attached to the annular groove 121 on the collar 12, the compression springs 61, 62, 63 and the front, intermediate and rear sockets 4, 2, 3 are respectively sleeved onto the rod base 1 and the nuts 51, 52, 53 are respectively screwed onto the first, second and third outer threads. When assembled, the first compression spring 61 is retained between the first nut 51 and the ring-shaped partition wall 32 of the rear socket 3; the second compression spring 62 is retained between the second nut 52 and the ring-shaped partition wall 23 of the intermediate socket 2; the third compression spring 63 is retained between the ring-shaped partition wall 41 of the front socket 4 and the third nut 53; the intermediate socket 2 has two opposite notched end edges 21, 22 respectively engaged with the notched ring 11 of the rod base 1 and the notched end edge 31 of the rear socket 3; the front socket 4 is sleeved onto the collar 12 and covered over the name plate 7. Therefore, the front, intermediate and rear sockets 4, 2, 3 are retained to the rod base 1 by the compression springs 61, 62, 63 and the nuts 51,52, 53. By pulling the front socekt 4 outwards relative to the rod base 1, the name plate 7 is exposed to the outside for identification.

Figure 3A:
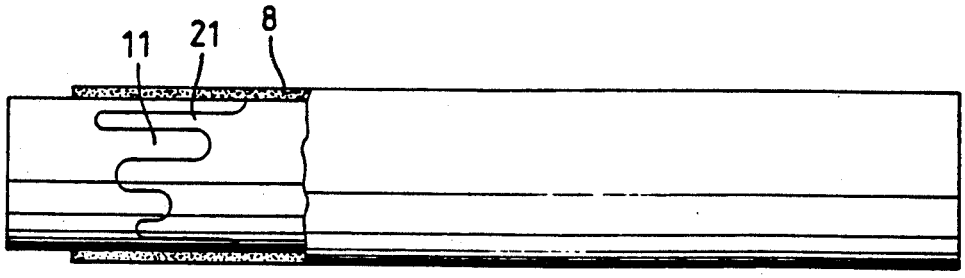
FIGS. 3A, 3B, 3C are plain views showing that the total length of the handle can be changed by changing the engagement order of the teeth.
Figure 3B:
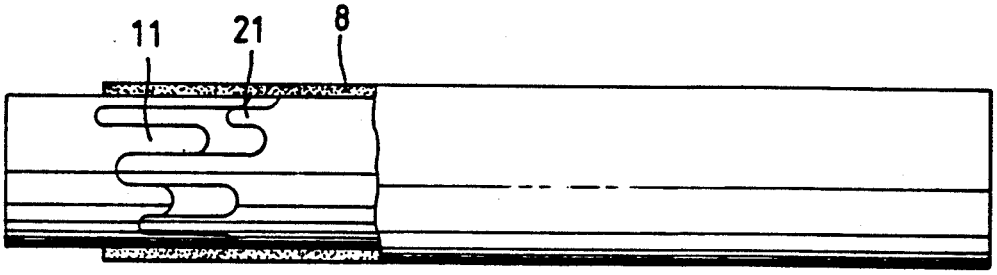
Figure 3C:
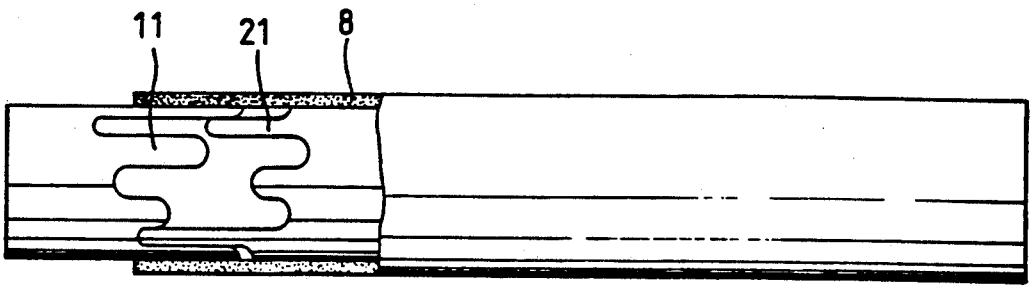

Referring to FIGS. 3A, 3B and 3C, by changing the engagement order of the teeth of the notched end edge 21 of the intermediate socket 2 with the teeth of the notched ring 11 of the rod base 1, the total length of the handle is changed. In the same manner, the engagement order of the teeth of the notched end edge 22 with notched end edge 31 of the rear socket 3 can also be changed, so as to adjust the total length of the handle. Furthermore, protective cushion rings 8 may be sleeved onto the handle and covered over the connecting area between the notched ring 11 and the intermediate socket 2, and the connecting area between the intermediate socket 2 and the rear socket 3.

Figure 4:
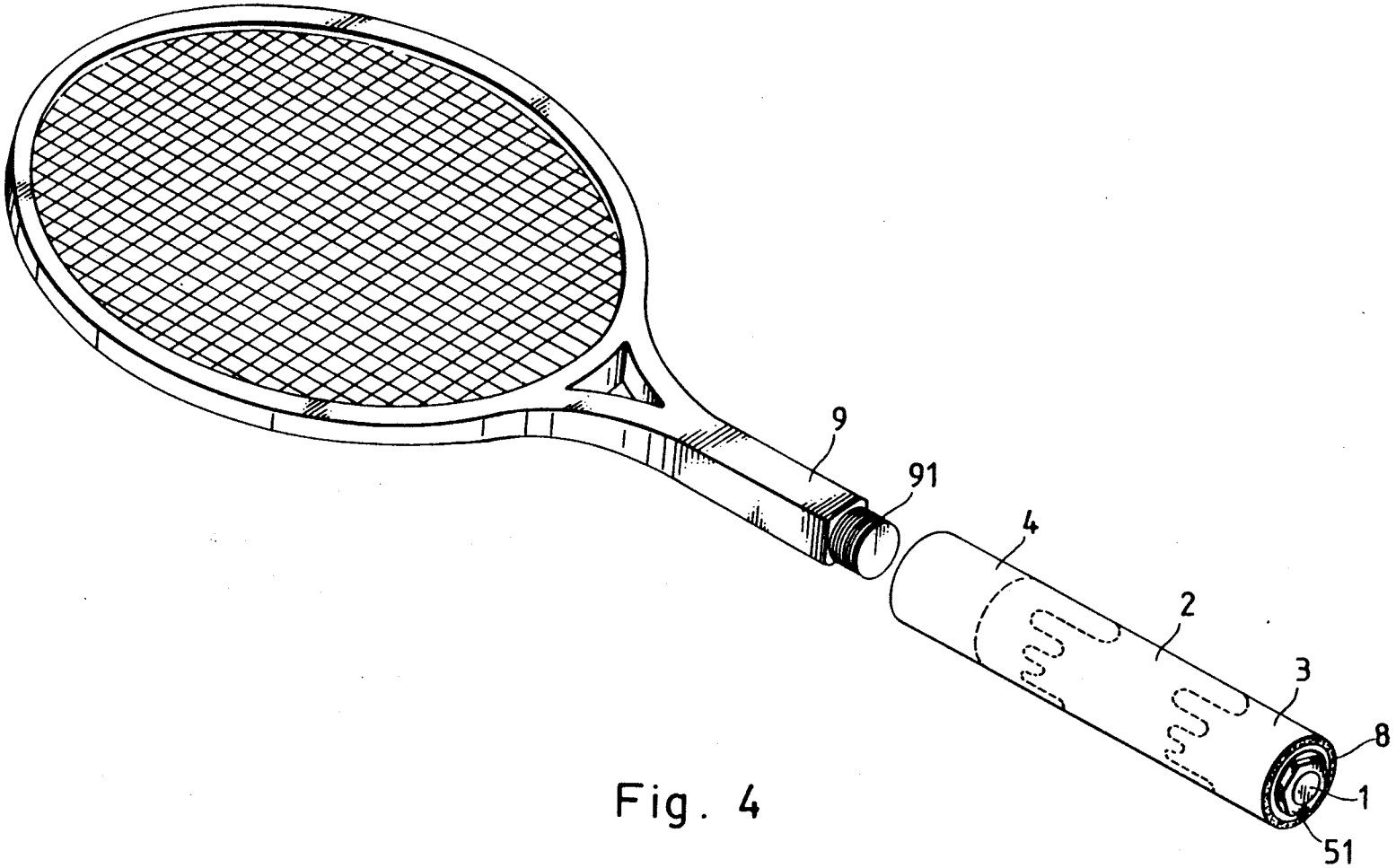
FIG. 4 is a perspective view showing an application example of the present invention for a socket.

Referring to FIG. 4, therein illustrated is an application example of the present invention for a racket. In this application example, the front socket 4 is made with an inner thread (not shown) at one end, into which the stub screw rod 91, which is formed on the rear end of the racket handle 9, is fastened.

The preferred embodiment described is simple in structure and therefore functional. It will be understood that various modifications and changes my be made without departing from the scope of the invention and the invention is not to be considered limited to what is shown in the drawings and described in the specification.

I claim:

1. A length adjustable handle comprising:

a rod base, said rod base being made from an elongated rod comprising a first outer thread at one end, a second outer thread near said first outer thread, a third outer thread at an opposite end, a collar and a notched ring concentrically formed between said second and third outer threads, said collar having an annular groove around a peripheral outside surface thereof, onto which a name plate is fastened, said notched ring being formed of a set of teeth respectively spaced by a set of grooves, said teeth and grooves varying in length;

a front socket sleeved onto said rod base at one end, said front socket being covered over said name plate and disposed in flush with said notched ring, and having a ring-shaped partition wall on the inside;

an intermediate socket sleeved onto said rod base and connected to said notched ring, said intermediate socket comprising a first notched peripheral end edge at one end engaged with said notched ring, a second notched peripheral end edge at an opposite end, and a ring-shaped partition wall on the inside, the first and second notched peripheral end edges of said intermediate socket being each formed of a set of teeth respectively spaced by a set of grooves said teeth and grooves varying in length;

a rear socket sleeved onto said rod base and connected to said intermediate socket, said rear socket comprising a notched peripheral end edge at one end engaged with the second notched peripheral end edge of said intermediate socket, and a ring-shaped partition wall on the inside, the notched peripheral end edge of said rear socket being formed of a set of teeth respectively spaced by a set of grooves said teeth and grooves varying in length;

three nuts, said three nuts including a first nut screwed onto said first outer thread, a second nut screwed onto said second outer thread, and a third nut screwed onto said third outer thread;

three compression springs respectively sleeved on said rod base, said three compression springs including a first compression spring retained between said first nut and the ring-shaped partition wall of said rear socket, a second compression spring retained between said second nut and the ring-shaped partition wall of said intermediate socket, and a third compression spring retained between said third nut and the ring-shaped partition wall of said front socket; and wherein by changing the engagement order of the teeth of the notched peripheral end edges of said intermediate socket with the teeth of said notched ring and the teeth of the peripheral end edge of said rear socket, the total length of the handle is changed.

* * * * *